US006702220B2

(12) United States Patent
Taylor

(10) Patent No.: US 6,702,220 B2
(45) Date of Patent: Mar. 9, 2004

(54) WEB STORAGE DEVICE FOR A PACKAGING MACHINE

(75) Inventor: Alfred Taylor, Chester Hill (AU)

(73) Assignee: TNA Australia PTY Limited, Chester Hill (AU)

( * ) Notice: Subject to any disclaimer, the term of this patent is extended or adjusted under 35 U.S.C. 154(b) by 0 days.

(21) Appl. No.: 10/099,857

(22) Filed: Mar. 14, 2002

(65) Prior Publication Data

US 2002/0139891 A1 Oct. 3, 2002

(30) Foreign Application Priority Data

Mar. 28, 2001 (AU) ..... PR4063

(51) Int. Cl.[7] ..... B65H 59/00

(52) U.S. Cl. ..... 242/417.3; 242/378.1; 242/331

(58) Field of Search ..... 242/417.3, 378, 242/378.1, 331

(56) References Cited

U.S. PATENT DOCUMENTS

| | | | | | |
|---|---|---|---|---|---|
| 1,984,749 | A | * | 12/1934 | Lamatsch | 242/417.3 |
| 2,262,587 | A | * | 11/1941 | Kaempf | 242/376 |
| 2,578,123 | A | * | 12/1951 | Bendfelt | 242/417.3 |
| 2,685,417 | A | * | 8/1954 | Bartelson | 242/417.2 |
| 4,315,394 | A | | 2/1982 | Noack | 53/553 |
| 4,441,664 | A | | 4/1984 | Stohlquist | 242/75.42 |
| 4,501,109 | A | | 2/1985 | Monsees | 53/451 |
| 4,603,800 | A | | 8/1986 | Focke et al. | 226/119 |
| 4,691,499 | A | | 9/1987 | Umeda et al. | 53/451 |
| 4,693,053 | A | | 9/1987 | Ballestrazzi et al. | 53/389 |
| 5,203,136 | A | * | 4/1993 | Thimon et al. | 53/399 |
| 5,317,858 | A | | 6/1994 | Hanai | 53/451 |
| 5,588,626 | A | * | 12/1996 | Yang | 242/378.1 |
| 6,237,383 | B1 | * | 5/2001 | Albert | 72/183 |

FOREIGN PATENT DOCUMENTS

| | | |
|---|---|---|
| GB | 1089792 | 11/1967 |
| GB | 2237008 | 4/1991 |
| JP | 58167017 | 10/1983 |

OTHER PUBLICATIONS

Patent Abstracts of Japan Publication No. 11–245916 dated Sep. 14, 1999.
Patent Abstracts of Japan Publication No. 2001–018920 dated Jan. 23, 2001.
Patent Abstracts of Japan Publication No. 2000–118512 dated Apr. 25, 2000.
Patent Abstracts of Japan Publication No. 10–119909 dated May 12, 1998.
Patent Abstracts of Japan Publication No. 10–119910 dated May 12, 1998.

* cited by examiner

*Primary Examiner*—Kathy Matecki
*Assistant Examiner*—Sang Kim
(74) *Attorney, Agent, or Firm*—Ladas & Parry

(57) ABSTRACT

A film storage device 20 to receive film 19 from a roll or roll 17 to deliver the film 19 to a packaging machine 10. The film storage device 20 includes a base 21 upon which there is pivotably mounted a carriage 22. The carriage 22 has a transverse passage 50 through which the film 19 passes to be wound about the periphery of the carriage 22. The carriage 22 is provided with a plurality of rollers 53 that facilitates movement of the film 19 through the device 20.

13 Claims, 5 Drawing Sheets

WEB STORAGE DEVICE FOR A PACKAGING MACHINE

TECHNICAL FIELD

The present invention relates to packaging machines that form a tubular bag material and deliver product to the interior thereof so that when the tubular bag material is transversely out and scaled discreet bags are formed. More particularly, the present invention relates to the delivery of plastic film to packaging machines.

BACKGROUND OF THE INVENTION

For example, in the manufacture of bags of snack foods, a tubular bag material is passed through the packaging machine. Product to be packaged is delivered into the interior of the tubular bag material with the tubular bag material then being transversely out and scaled to form discreet bags. Plastic film that forms the bag is passed about a former which forms the tubular bag material. The plastic film is delivered from rolls which are mounted on driven spindles, with the plastic film passing through a film storage device prior to delivery to the former. The film storage device aids maintaining a continuous supply of film to the packaging machine. The film is stored within the device to aid in overcoming fluctuations in the ratio of delivery and the rate of use of the plastic film.

The above-mentioned storage devices have included a pivotally mounted arm with a series of rollers about which the film passes. Pivoting movement of the arm aids in compensating for any differences in the rate of supply and the used rate of the film. These pivotally mounted arms have a number of disadvantages including not being able to determine with required accuracy the amount of material stored in the device and not being able to at all times maintain the correct tension in the film being delivered to the packaging machine.

Further disadvantages include the device occupying considerable space and being difficult to feed film through.

Previous film storage devices are disclosed in Patent Specifications GB2237008, U.S. Pat. Nos. 4,441,664, 5,317,858, JP08-301210 (Publication No. 10-119910), JP08-29 (Publication No. 10-119909), JP10-290828 (Publication No. 2000-118512), JP11-199092 (Publication No. 2001-018920), JP10-053989 (Publication No. 11-245916), GB1089792, U.S. Pat. Nos. 4,315,394, 4,693,053, 4,501,109 and 4,691,499. Each of these previously known devices has a film storage device which essentially includes one or more roller that moves substantially nearly relative to a fixed roller in order to store the film.

Disclosed in U.S. Pat. No. 4,315,394 is a device to tension film. The device includes a slit roller through which the film passes. The slip is spaced from the longitudinal axis of the roller so that angular movement of the roller adjusts the tension in the film. The roller is intended to act as a film storage device so it is relatively small in diameter and has the slip spaced from the longitudinal axis of the roller which would thereby limit the amount of film that can be stored.

OBJECT OF THE INVENTION

It is the object of the present invention to overcome or substantially ameliorate at least one of the above disadvantages.

SUMMARY OF THE INVENTION

There is disclosed herein a film storage device to receive film from a roll and to deliver the film to a machine, said device including:

a base which is to be stationary;

a carriage mounted on the base for pivoting movement about a fixed axis relative to the base and having a periphery about which the film is to be wound so as to store portions of the film;

a torque applying member engaging the carriage so as to urge the carriage to pivot about said axis in a predetermined direction; and a film passage extending through the carriage transversely through said axis and between angularly spaced locations on said periphery so that film in use passes through the passage to be wound about said periphery.

There is further disclosed herein a film storage device to receive film from a roll and to deliver the film to a machine that uses the film, said device including:

a base which is stationary;

a carriage mounted on the base for pivoting movement about a carriage axis and having a periphery about which the film is to be wound so as to store portions of the film, said periphery including a plurality of rollers mounted on the carriage for rotation about axes parallel to said carriage axis;

a torque applying member engaged in a carriage so as to urge the carriage to pivot about said carriage axis in a predetermined direction; and a film passage extending through the carriage transversely with respect to said carriage axis and between angularly spaced locations on said periphery so that film in use passes through the passage to be wound about said periphery.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
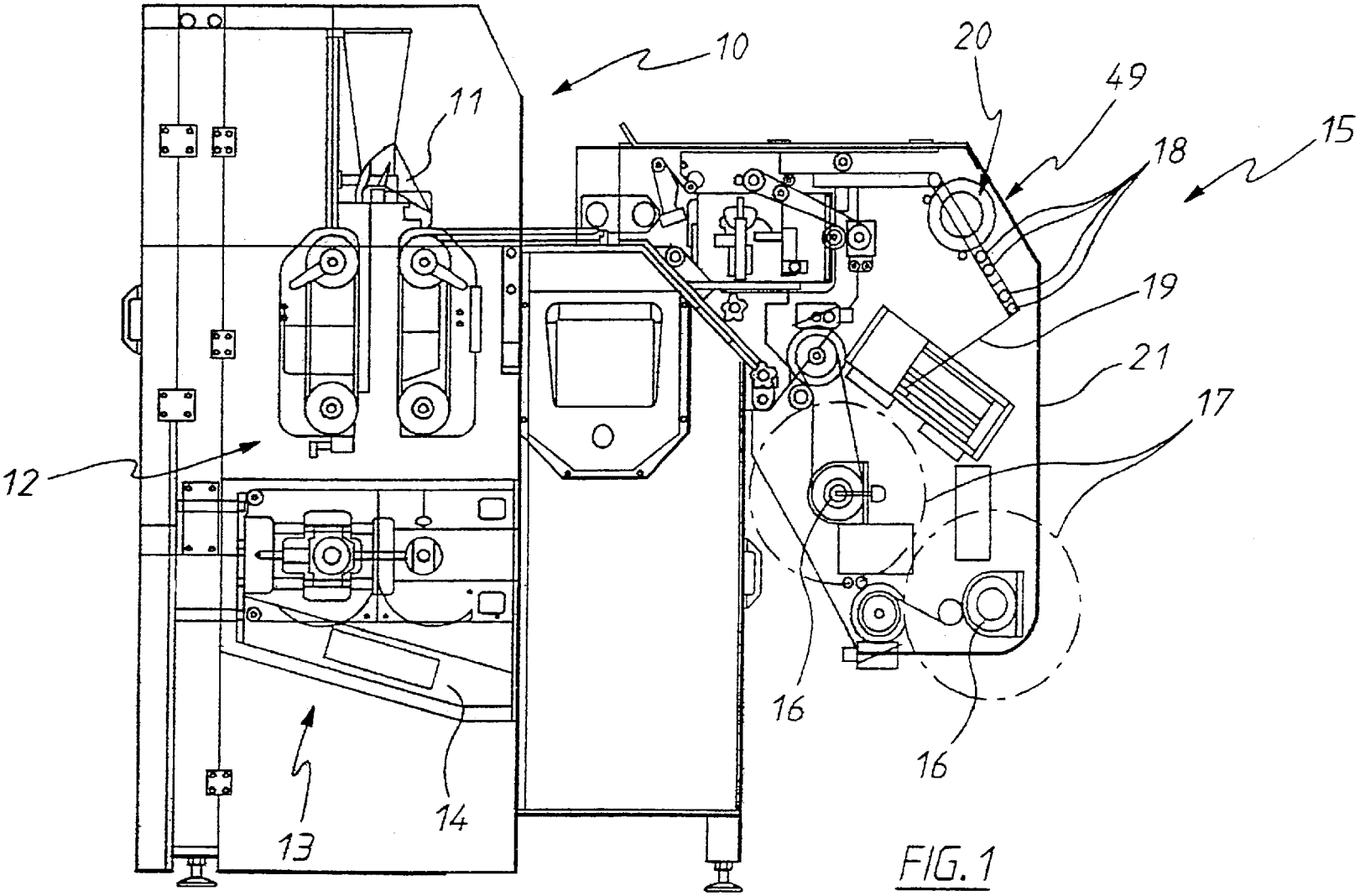
FIG. 1 is schematic side elevation of a packaging machine and associated film delivery assembly.
Figure 5:
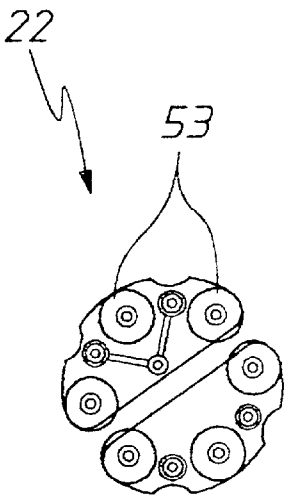
FIG. 5 is a further end elevation of the device of FIG. 2.
Figure 2:
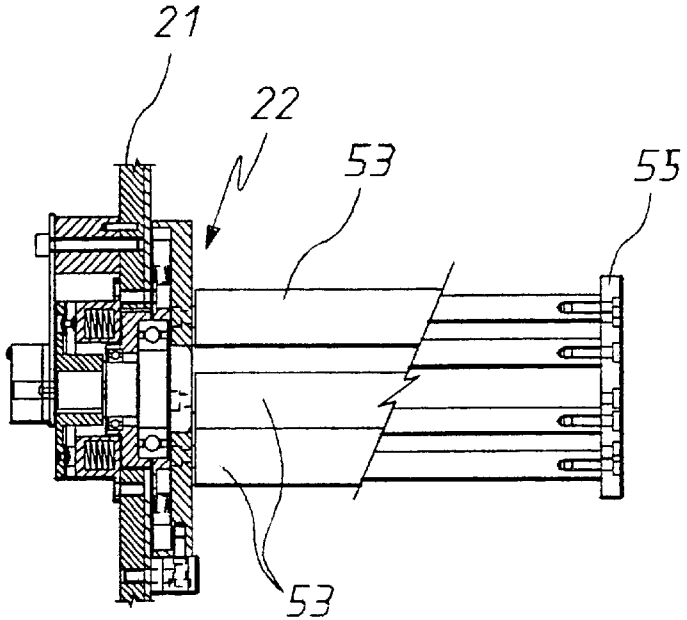
FIG. 2 is a schematic side elevation of a film storage device.
Figure 3:
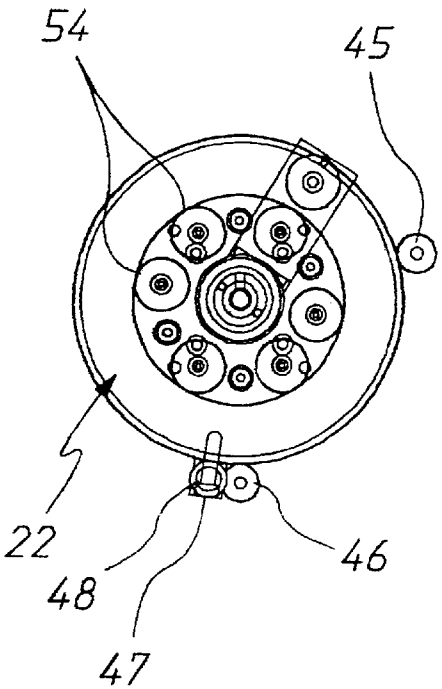
FIG. 3 is a schematic and elevation of the device of FIG. 2.
Figure 4:
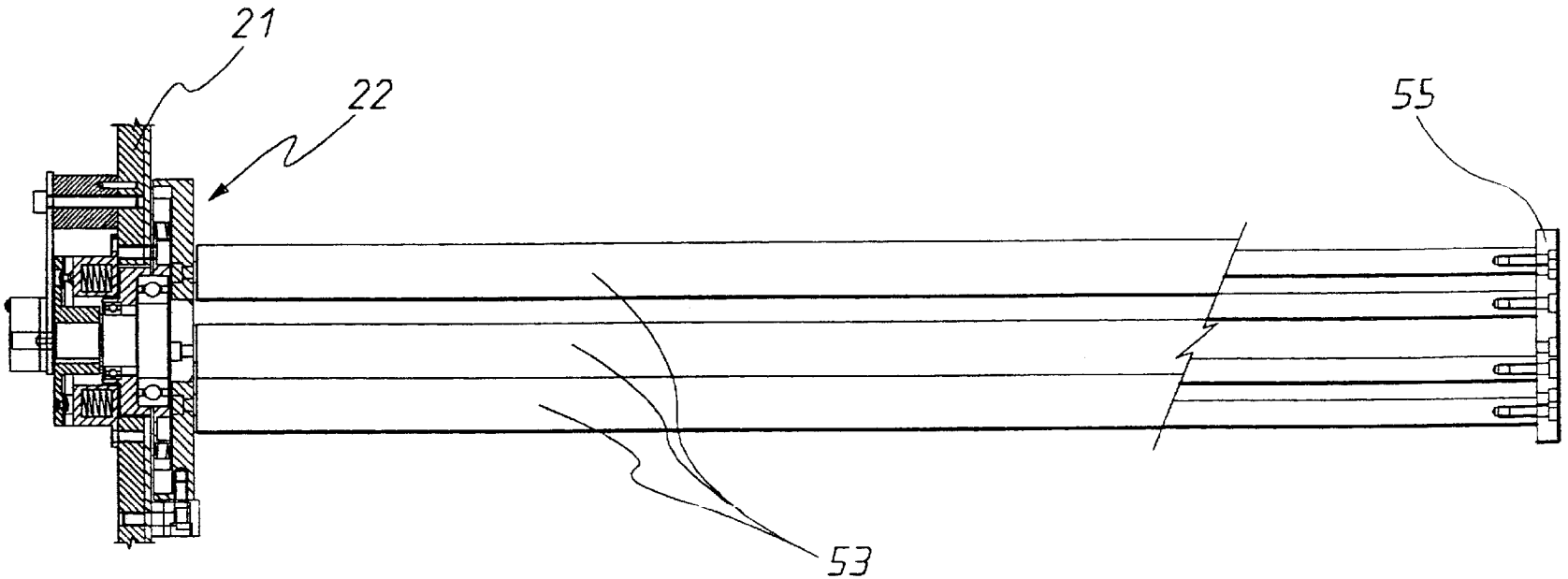
FIG. 4 is a further side elevation of the device of FIG. 2.
Figure 6:
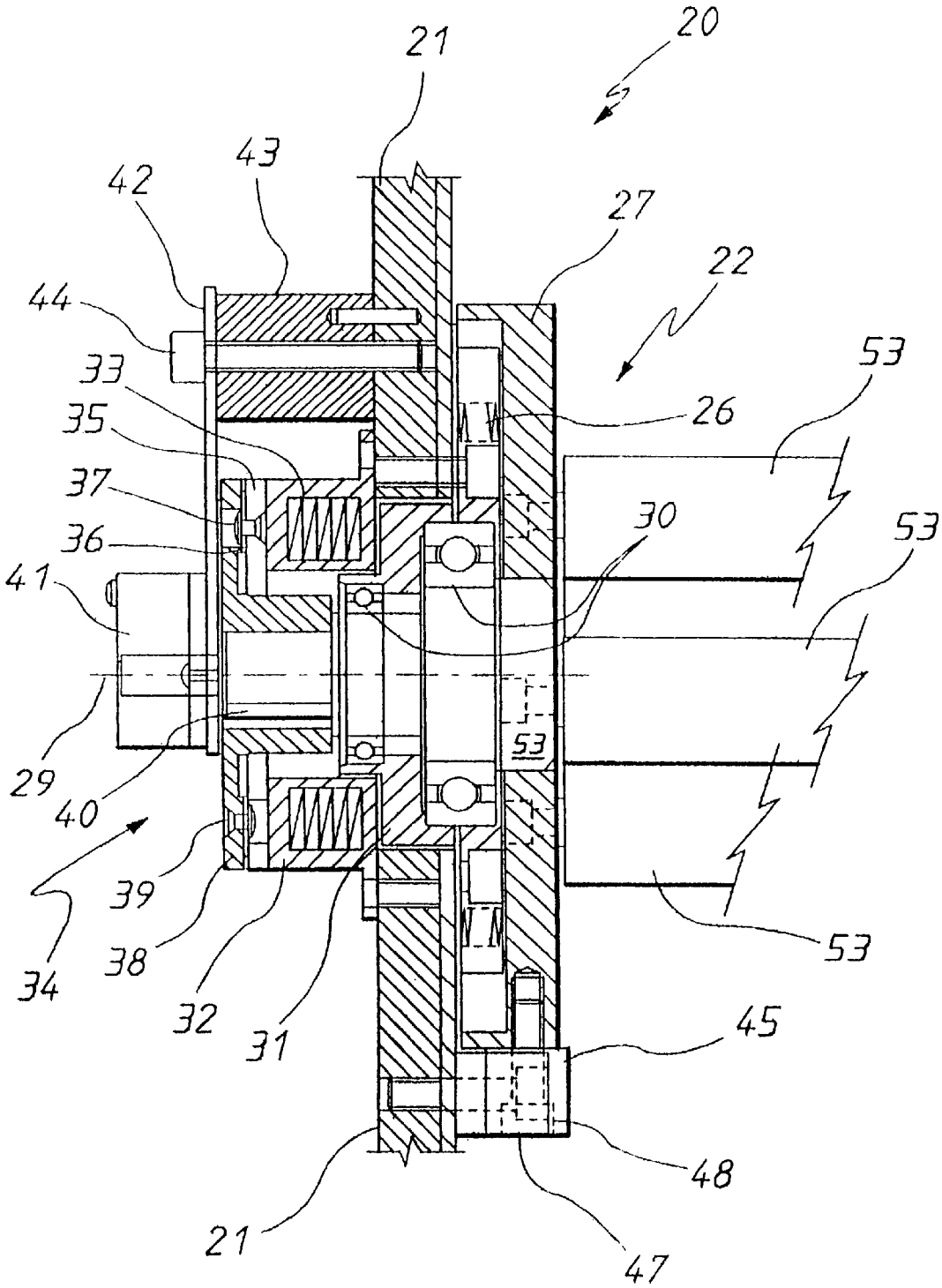
FIG. 6 is an enlarged view of a portion of the device as shown in FIG. 2.

In the accompanying drawings there is schematically depicted a packaging machine 10. The packaging machine 10 receives plastic film (web) and passes the film about a former 11 to form tubular bag material. The tubular bag material is pulled through the machine 10 by belt drive assemblies 12 which deliver the tubular bag material to sealing and cutting jaws 13 so that discreet bags of product are delivered to a chute 14. Product is delivered to the interior of the tubular bag material through the interior of the former 11.

Film delivered to the former 11 comes from a film supply assembly 15. The film supply assembly 15 includes rotatable driven shafts 16 which support rolls 17 of plastic film 19.

The plastic film 19 is taken from one of the rolls 17 and is delivered to a series of rollers 18. The plastic film 19 weaves through the rollers 18 to be delivered to a film storage device 20. From the device 20, the film 19 is delivered to the former 11.

The film storage device 20 includes a base 31 which pivotally supports a carriage 22 about which the film 19 is wound so as to be stored thereby. The carriage 22 is urged to rotate in the direction of the arrows 23 to a maximum film storage position 24, from a minimum storage position 25. More particularly, the carriage 22 is urged to move in the direction of the arrows 23 by means of coil spring 26 having one end fixed with respect to the base 21 and having another end fixed to the carriage 22. The spring 26 applies a torque to the carriage 22 in the direction of the arrows 23.

Figure 7:
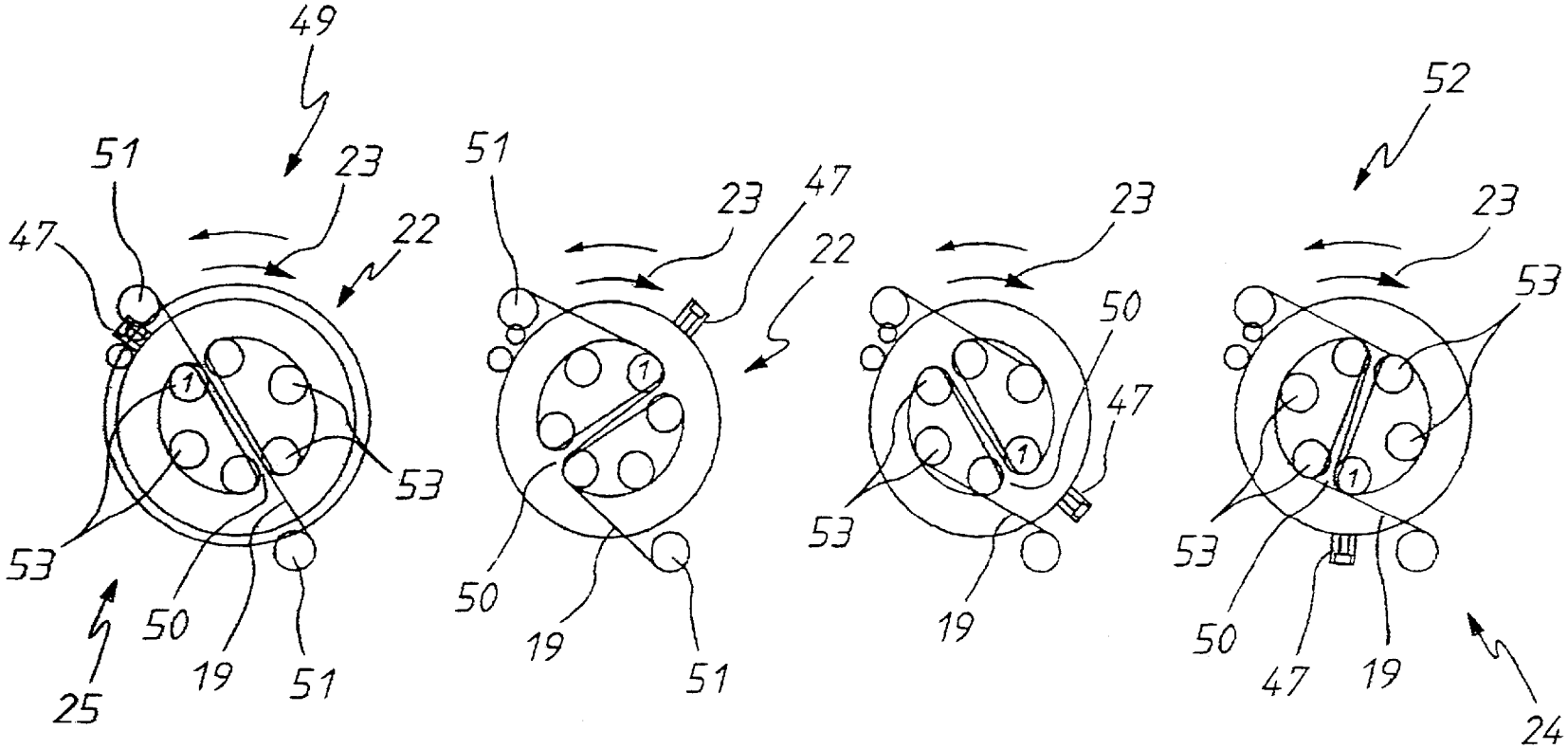
FIG. 7 is schematic and elevations illustrating operation of the device of FIG. 2.

The carriage 22 includes a mounting 27 upon which there is mounted a plurality of rollers 53 which provide the periphery about which the film 19 is wound as illustrated in FIG. 7. Each of the rollers 53 is rotatable mounted for rotation about its longitudinal axis relative to the mounting 27.

The carriage 22 further includes a shaft 28 welded to the mounting 27 so the mounting 27 can pivot about the longitudinal axis 29. More particularly, the carriage 22 is mounted by way of bearings 30 for movement about the axis 29, which axis 29 is fixed with respect to the base 21.

Attached to the base 21 is a bearing housing 31 as well as a coil housing 32 supporting a coil 33. The coil 33 is part of a brake assembly 34 which is operable to retain the carriage 22 stationary. The assembly 34 further includes a brake disc 35 urged away from engagement with the housing 32 by means of a disc spring 36. The disc 35 is attached to the spring 36 by means of rivets 37 while the spring 36 is attached to an end member 38 by means of rivets 39. More particularly, the member 38 is fixed to the shaft 28 by means of a key 40. When the coil 33 is electrically energised the disc 35 is drawn into engagement with the housing 32 so that the carriage 22 is maintained stationary with respect to the base 21. When the coil 33 is no longer energised the spring 36 moves the disc 35 from conduct with the housing 32.

Associated with the end of the shaft 28 is an encoder 41 which provides a signal indicative of the angular displacement of the carriage 22 thereby enabling calculation of the length of web stored within the device 20.

The encoder 41 is maintained stationary relative to the shaft 28 by means of a bracket 42 fixed to the base 21 by means of a spacer 43 and bolt 44.

The angular limits of rotation of the carriage 22 and therefore the shaft 28 are defined by stops 45 (maximum storage position) and 46 which stops engaging mounting 47 fixed to the carriage 22. A proximity switch 48 is mounted in the base 21 adjacent the stop 46 to provide a signal indicating when the carriage 22 is engaged with the stop 45. The stops 45 and 46 are attached to the base 21 and are therefore stationary. The stops 45 and 46 are spaced by 240° thereby limiting movement of the carriage 22 to that angular displacement.

The carriage 22 is provided with a transverse passage 50 through which the film 19 passes. The passage 50 extends transverse of the axis 29 between two angularly spaced location on the periphery of the carriage 22 to thus enable the film 19 to pass through the carriage 22 to be wound about the periphery of the carriage 22, that is the rollers 53. With reference to FIG. 7, when the carriage 22 is in the position 49 the passage 50 is aligned with two stationary rollers 51 between which the web 19 passes. The rollers 51 would be mounted on the base 21. This would normally be the feed position when the web is initially being fed through the carriage 22. However the spring 26 urges the carriage 22 to move in the direction of the arrow 23 until it reaches the limit position 52. At the position 52 the maximum amount of web 19 is stored. In this embodiment, the passage 50 extends through the axis 29. As can be seen in the drawing, the passage 50 and axis 29 are in a common plane.

When the film 19 is being fed through the passage 50, typically the brake assembly 34 would be activated so that the carriage 22 is maintained stationary with the passage 50 aligned with the rollers 51.

The remote ends of the rollers t3 are secured within an end plate 55 for rotation relative thereto about the longitudinal axes of the rollers 53, that is axes parallel to the axis 29. The rollers 53 facilitate movement of the film 19 through the device 20 as the rollers 53 rotate with the movement of the film 19.

The claims defining the invention are as follows:

1. In a combination a packaging machine that receives film and forms packages therefrom and a film storage device to receive the film from a roll and to deliver the film to the machine, the improvements of said device including:

a base which is to be stationary;

a carriage mounted on the base for pivoting movement about a carriage axis and having a periphery about which the film is to be wound so as to store portions of the film;

a torque applying member engaging the carriage so as to pivot the carriage about said carriage axis in a predetermined direction; and a film passage extending through the carriage transversely through said axis and between angularly spaced locations on said periphery so that film in use passes through the passage to be wound about said periphery.

2. The combination of claim 1 wherein said periphery includes a plurality of rollers to engage the film, the rollers being rotatably mounted on the carriage for angular movement about axes parallel to said carriage axis.

3. The combination of claim 2 wherein said torque applying member is a coil spring.

4. The combination of claim 1 wherein said carriage axis is fixed relative to said base.

5. In a combination a packaging machine that receives film and forms packages therefrom and film storage device to receive film from a roll and to deliver the film to said machine, the improvements of said device including:

a base which is stationary;

a carriage mounted on the base for pivoting movement about a carriage axis and having a periphery about which the film is to be wound so as to store portions of the film, said periphery including a plurality of rollers mounted on the carriage for rotation about axes parallel to said carriage axis;

a torque for applying member engaged with the carriage so as to pivot the carriage about said carriage axis in a predetermined direction; and a film passage extending through the carriage transversely with respect to said carriage axis and between angularly spaced locations on said periphery so that film in use passes through the passage to be wound about said periphery.

6. The combination of claim 5 wherein said carriage axis is fixed with respect to said base.

7. The combination of claim 6 wherein said passage and said carriage axis is located in a single plane so that said passage passes through said carriage axis.

8. The combination of claim 7 wherein said torque applying member is a coil spring.

9. A film storage device to receive film from a roll land to deliver the film to a packaging machine that forms the film into bags, said device including:

a base;

a carriage mounted on the base for pivoting movement about a carriage axis and having a periphery about which the film is to be wound so as to store portions of the film, the periphery including a plurality of rollers mounted on the carriage for rotation about axes parallel to said carriage axis;

a torque applying member operatively associated with the carriage to pivot the carriage about said carriage axis in a predetermined direction;

a film passage extending through the carriage transversely with respect to said carriage axis and between angularly spaced locations on said periphery so that film in use passes through the passage to be wound about said periphery; and a brake mechanism operable to selectively prevent angular movement of the carriage.

10. The film storage device of claim 9 wherein said brake mechanism includes a brake member movable between a first position at which the brake member permits angular movement of the carriage, and a second position operatively associated with the carriage to prevent angular movement thereof.

11. The film storage device of claim 10 wherein said base is stationary, and said carriage axis is fixed with respect to said base.

12. The film storage device of claim 11 wherein said passage and said carriage axis are located in a single plane and said passage passes through said carriage axis.

13. The film storage device of claim 12 wherein said torque applying member is a coil spring.

* * * * *